US005879013A

United States Patent [19]

Shih

[11] Patent Number: 5,879,013

[45] Date of Patent: Mar. 9, 1999

[54] WHEEL AXLE MOUNTING STRUCTURE OF A ROLLER SKATE

[76] Inventor: Guo-Nan Shih, Lane 91, Alley 3, No. 43, 5F., Pateh Rd., Sec. 4, Taipei, Taiwan

[21] Appl. No.: 815,706

[22] Filed: Mar. 12, 1997

[51] Int. Cl.[6] ..... A63C 3/00

[52] U.S. Cl. ..... 280/11.28; 280/809; 280/87.042; 301/137

[58] Field of Search ..... 301/5.7, 137; 180/905; 280/11.27, 11.28, 809, 811, 87.042, 157

[56] References Cited

U.S. PATENT DOCUMENTS 2,275,035 3/1942 Pardon ..... 280/11.28
2,405,000 7/1946 Whited ..... 280/809
2,505,154 4/1950 Smith ..... 280/809 X
4,214,768 7/1980 Dominy et al. ..... 280/809

*Primary Examiner*—Robert J. Oberleitner
*Assistant Examiner*—Michael Mar
*Attorney, Agent, or Firm*—Varndell Legal Group

[57] ABSTRACT

A wheel axle mounting structure including an axle holder fastened to a mounting frame at a bottom side of a sole plate of a roller skate by a bolt and a pair of cushions and a pair of ring caps and having a holder base holding an axle, two wheels mounted on two opposite ends of the axle and a guard frame fastened to the axle to protect the holder base of the axle holder, wherein the guard frame has two end caps with coupling means respectively and detachably coupled to the two opposite ends of the axle, the end caps having a respective outside flange respectively disposed in contact with the wheels and serving as cushion means.

8 Claims, 4 Drawing Sheets

WHEEL AXLE MOUNTING STRUCTURE OF A ROLLER SKATE

BACKGROUND AND SUMMARY OF THE INVENTION

The present invention relates to a wheel axle mounting structure for a roller skate, and more particularly to such a wheel axle mounting structure which comprises a stainless steel guard frame for protecting the parts of the wheel axle mounting structure.

In a roller skate, a guard may be provided to protect the axle holder. The guard is molded from plastic and directly clamped on the holder base of the axle holder, having a locating plate in the middle sandwiched in between a mounting frame, which is fixed to the sole plate of the roller skate, and a top ring cap, which holds a top cushion above the axle holder. This guard mounting arrangement has drawbacks. Because the two opposite ends of the guard are suspended from the holder base of the axle holder, the guard tends to displace, and the locating plate of the guard tends to be broken, thereby causing the guard to disconnect from the axle holder.

The present invention has been accomplished to provide a wheel axle mounting structure for a roller skate which eliminates the aforesaid drawbacks. According to one aspect of the present invention, the wheel axle mounting structure comprises an axle holder fastened to a mounting frame at a bottom side of a sole plate of a roller skate by a bolt and a pair of cushions and a pair of ring caps and having a holder base holding an axle, two wheels mounted on two opposite ends of the axle and a guard frame fastened to the axle to protect the holder base of the axle holder, wherein the guard frame has two ends caps with coupling means respectively and detachably coupled to the two opposite ends of the axle, the end caps having a respective outside flange respectively disposed in contact with the wheels and serving as cushion means. Because the outside flanges of the end caps serve as cushion means, the installation of the wheels is simplified. According to another aspect of the present invention, coupling means of each end cap comprises a mounting slot by which the respective end cap is forced into engagement with the axle, a locating slot intersecting the mounting slot for permitting the axle to be retained in the crossed area between the mounting slot and the locating slot. According to still another aspect of the present invention, the mounting slot has a width made gradually wider from the locating slot toward the outside, therefore the end caps of the guard frame can be conveniently attached to the axle. According to still another aspect of the present invention, the end caps of the guard frame comprise a respective pair of projecting strips respectively hooked on respective end edges of the holder base of the axle holder, and therefore the guard frame is firmly secured to the axle holder.

DETAILED DESCRIPTION OF THE PREFERRED EMBODIMENT

Figure 1:
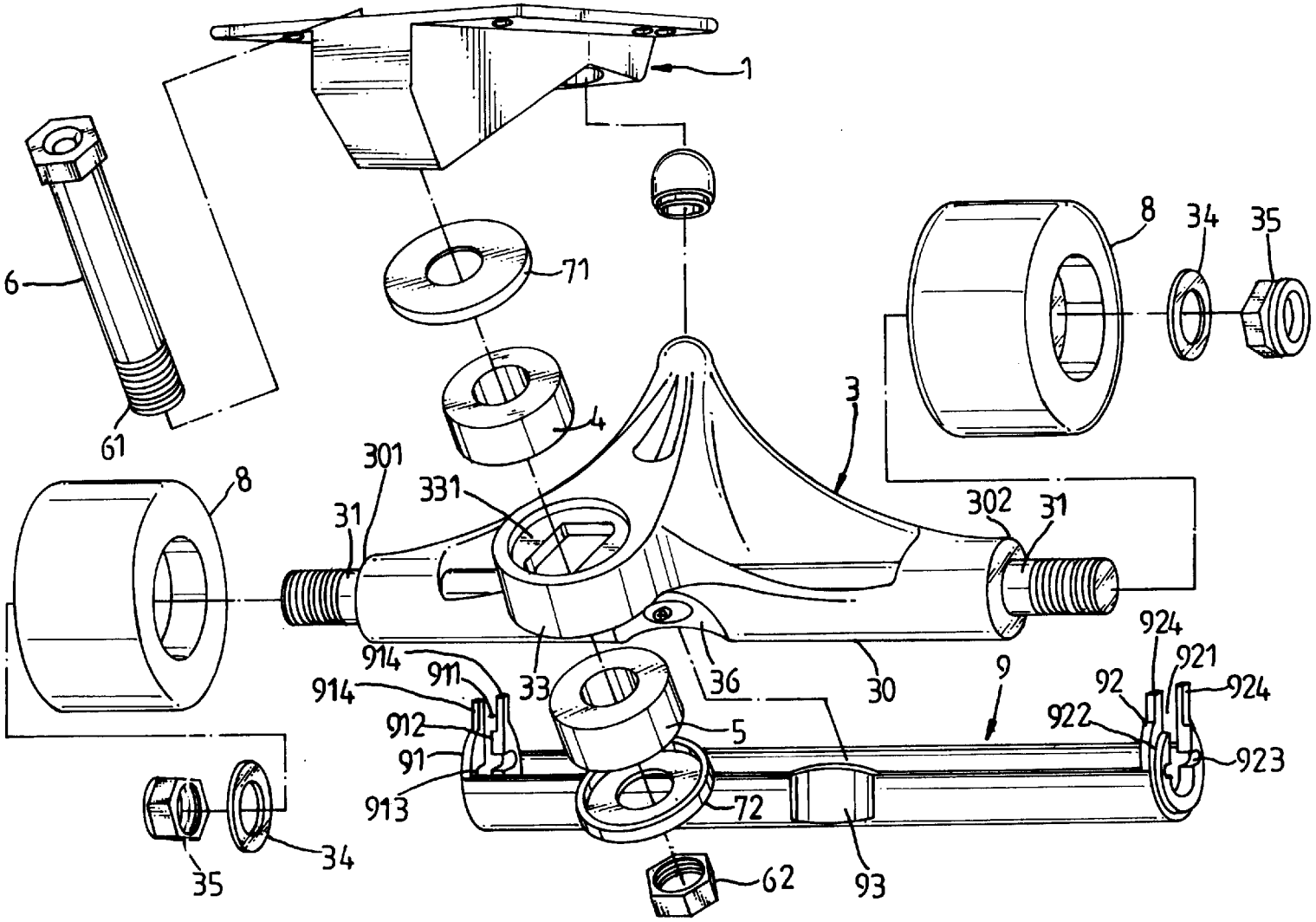
FIG. 1 is an exploded view of a hweel axle mounting structure according to the present invention.
Figure 2:
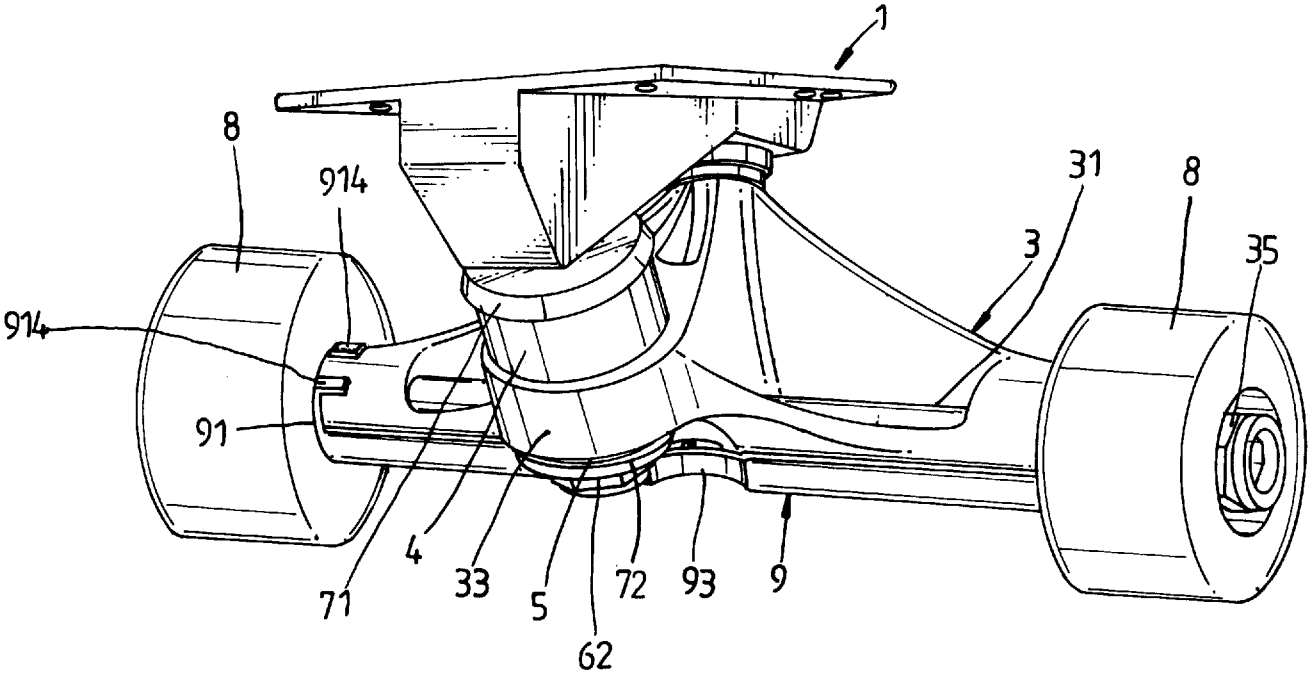
FIG. 2 is an assembly view of the wheel axle mounting structure shown in FIG. 1.

Referring to FIGS. 1 and 2, a wheel axle mounting structure of a roller skate in accordance with the present invention is generally comprised of a mounting frame 1, an axle holder 3, a first cushion 4, a second cushion 5, a first ring cap 71, a second ring cap 72, an action bolt 6, a lock nut 62, and a guard frame 9.

The mounting frame 1 is fixedly secured to a sole plate of a roller skate (not shown). The axle holder 3 comprises a holder base 30, and axle 31 fixedly mounted in the holder base 30 holding a pair of wheels 8 at its two opposite ends by washers 34 and nuts 35, and a hollow locating block 33 forwardly raised from the holder base 30 in the middle and defining top and bottom recesses 331 adapted for receiving the first cushion 4 and the second cushion 5 respectively. The action bolt 6 is inserted in proper order through a mounting hole (not shown) in the mounting frame 1, the first ring cap 71, the first cushion 4, the hollow locating block 33, the second cushion 5 and the second ring cap 72, and then the lock nut 62 is threaded onto the outer thread 61 of the action bolt 6. The guard frame 9 fits over the holder base 30 of the axle holder 3, comprising two end caps 91; 92 mounted on the two opposite ends of the axle 31 of the axle holder 3. The end caps 91; 92 comprise a respective mounting slot 911; 921 by which the end caps 91; 92 are respectively forced into engagement with the axle 31, a respective outside flange 912; 922 respectively disposed in contact with a respective inside wall of the wheels 8 to serve as cushion means, a respective locating slot 913; 923 intersecting the respective mounting slot 911; 921 for permitting the axle 31 to be retained in the crossed area between the mounting slot 911; 921 and the locating slot 913; 923, and a respective pair of projecting strips 914; 924 respectively bent inwards and hung on edges 301; 302 of the holder base 30 of the axle holder 3. The width of the mounting slot 911; 921 is made gradually wider from the locating slot 913; 923 toward the outside, so that the axle 31 can be conveniently removed from the end caps 91; 92. The guard frame 9 further comprises an arched portion 93 in the middle fitted into an arched front recess 36 on the holder base 30 of the axle holder 3 below the hollow locating block 33 for positioning.

Figure 3:
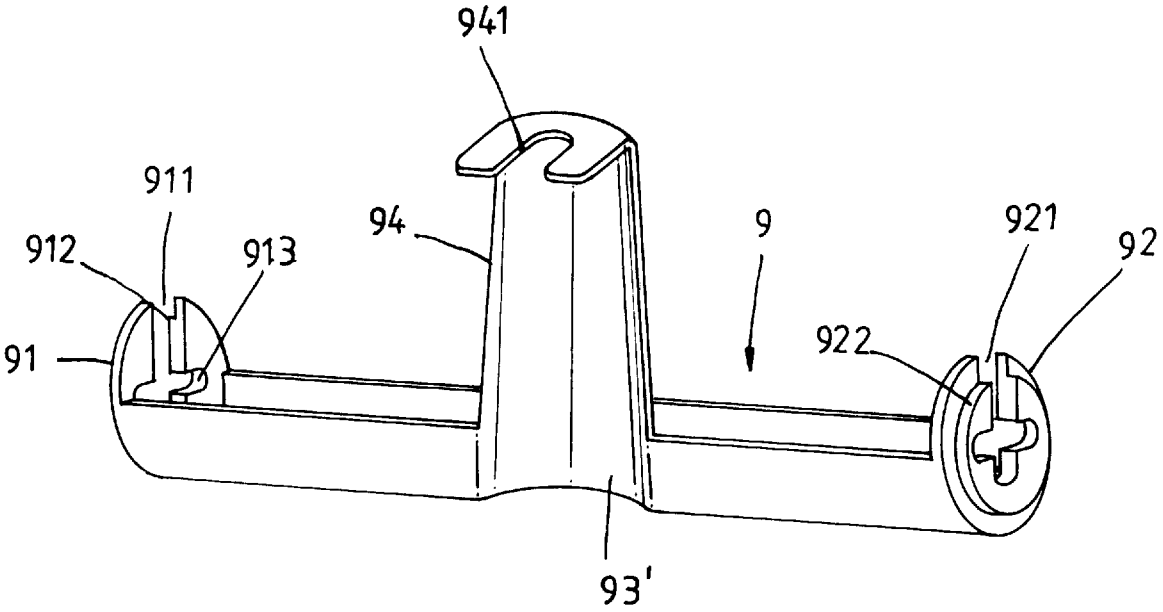
FIG. 3 is an elevational view of an alternate form of the guard frame for the wheel axle mounting structure according to the present invention.

FIG. 3 shows an alternate form of the guard frame 9 in which a locating plate 94 extends from the arched portion 93'. The locating plate has a top end perpendicularly turned inwards and terminating in a coupling portion 941 adapted to be retained in between the first ring cap 71 and the mounting frame 1 by the action bolt 6 and the lock nut 62.

Figure 4:
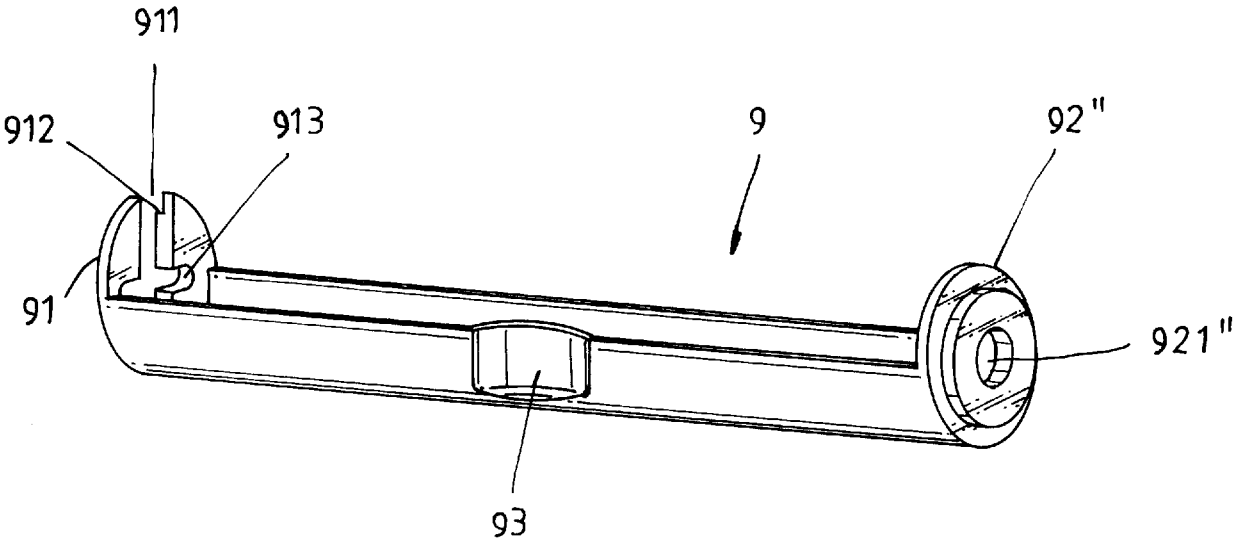
FIG. 4 is an elevational view of another alternate form of the guard frame according to the present invention.

FIG. 4 shows another alternate form of the guard frame 9 in which one end cap 92" is made in the form of a stepped ring defining a center through hole 921" for receiving the axle 31 of the axle holder 3.

I claim:

1. A wheel axle mounting structure comprising:

a mounting frame fixedly secured to a sole plate of a roller skate;

an axle holder fastened to said mounting frame and having a holder base for holding an axle with two opposite ends of the axle extending therefrom;

an action bolt mounted in said mounting frame to secure said axle holder in place;

a lock nut threaded onto said action bolt to fix said axle holder, said mounting frame and said action bolt together;

two wheels respectively mounted on two opposite ends of said axle by washers and nuts;

a first cushion mounted around said action bolt and retained between said mounting frame and said axle holder;

a second cushion mounted around said action bolt and retained between said axle holder and said lock nut;

a first ring cap mounted around said action bolt and retained between said mounting frame and said first cushion;

a second ring cap mounted around said action bolt and retained between said second cushion and said lock nut; and a guard frame fastened to said axle holder to protect said holder base;

wherein said guard frame includes an elongated portion covered over said holder base of said axle holder and two end caps integrally formed with said elongated portion and having a respective coupling means respectively fastened to the two opposite ends of said axle and retained between said holder base and said wheels, said coupling means including a mounting slot formed in at least one of said end caps for receiving a respective axle, and a respective flange formed on an outer end of each said end cap in contact with an inside wall of a respective wheel and serving as cushion means.

2. The wheel axle mounting structure of claim 1 wherein said holder base of said axle holder has an arched front recess in a middle portion; said guard comprises an arched portion in the middle of said elongated portion which is fitted into the arched front recess of said holder base of said axle holder for positioning.

3. The wheel axle mounting structure of claim 1 wherein the coupling means of both of said end caps of said guard frame comprises a mounting slot by which the respective end cap is forced into engagement with said axle, a locating slot intersecting each said mounting slot for permitting said axle to be retained in the crossed area between said mounting slot and said locating slot.

4. The wheel axle mounting structure of claim 3 wherein said mounting slot has a width made gradually wider from said locating slot toward the outside.

5. The wheel axle mounting structure of claim 1 wherein the end caps of said guard frame comprise a respective pair of projecting strips respectively hooked on respective end edges of said holder base of said axle holder.

6. The wheel axle mounting structure of claim 1 wherein said guard frame is preferably made from stainless steel.

7. The wheel axle mounting structure of claim 1 wherein said guard frame further comprises a locating plate extending from said arched portion, said locating plate having a top end perpendicularly turned inwards and terminating in a coupling portion adapted to be retained in between said first ring cap and said mounting frame by said action bolt and said lock nut.

8. The wheel axle mounting structure of claim 1 wherein the coupling means of one end cap of said guard frame comprises a center through hole coupled to one end of said axle; the coupling means of the other end cap of said guard frame being said mounting slot by which the respective end cap is forced into engagement with said axle, and a locating slot intersecting said mounting slot for permitting said axle to be retained in the crossed area between said mounting slot and said locating slot.

* * * * *